United States Patent [19]

Stoian et al.

[11] Patent Number: 4,702,487

[45] Date of Patent: Oct. 27, 1987

[54] PROCESS OF ORGANIC MATERIAL EXTRACTION FROM BITUMINOUS SANDS OR OIL BEARING SANDS

[75] Inventors: Anatol Stoian; Nicolita Panaitescu; Marioara Tuliu, all of Bucharest, Romania

[73] Assignee: Institutul de Cercetari Si Poriectari Pentru Petrol Si Gaze, Cimpina, Romania

[21] Appl. No.: 511,792

[22] Filed: Jul. 7, 1983

Related U.S. Application Data

[63] Continuation-in-part of Ser. No. 269,821, Jun. 3, 1981, abandoned.

[51] Int. Cl.[4] ..... C10G 1/04

[52] U.S. Cl. ..... 208/390

[58] Field of Search ..... 208/11 LE, 390

[56] References Cited

U.S. PATENT DOCUMENTS

| | | | |
|---|---|---|---|
| 2,871,180 | 1/1959 | Lowman et al. | 208/11 LE |
| 2,965,557 | 12/1960 | Price | 208/11 LE |
| 3,875,046 | 4/1975 | Rosenbloom | 208/11 LE |
| 4,017,377 | 4/1977 | Fairbanks et al. | 208/11 LE |
| 4,067,796 | 1/1978 | Alford et al. | 208/11 LE |
| 4,105,537 | 8/1978 | McQuitty | 208/11 LE |
| 4,110,195 | 8/1978 | Harding | 208/11 LE |
| 4,120,775 | 10/1978 | Murray et al. | 208/11 LE |
| 4,120,777 | 10/1978 | Globus | 208/11 LE |
| 4,130,474 | 12/1978 | Anthony | 208/11 LE |

*Primary Examiner*—Donald B. Moyer

*Assistant Examiner*—Joseph A. Boska

*Attorney, Agent, or Firm*—Karl F. Ross; Herbert Dubno; Jonathan Myers

[57] ABSTRACT

This invention relates to an improved process for extraction organic material from bituminous sands or oil bearing sand, including: diluent slurrying in a conditioning drum; screening the slurry and directing it into one or two helical classifiers in counter-current with diluent, to obtain in the overflow the organic matter in solution with diluent; feeding the mineral matter, withdrawn from the classifiers, substantially free of bitumen or oil, but saturated with diluent, into a column where it settles towards the bottom through diluent and then through an aqueous medium, under and in direct contact with the diluent. Process control agents are added to the aqueous medium. Diluent and fresh water are continuously fed into the vessel. From the column there are withdrawn: an oil-diluent product, in the upper part, to be recycled to the previous process phases; a water product, containing some impurities, in the middle part, to be treated and recycled; a wet mineral phase, substantially free of oil, at the bottom. If necessary, this last product may be finally washed in a helical classifier, in counter-current with water, to recover any remanent oil or diluent. The diluent losses in the process are replaced by an appropriate distillation control in the refining phase to obtain a constant diluent flow. Consequently the diluent used in the process will be made of the organic matter light ends of the processed bitumen or oil with no diluent supply.

10 Claims, 1 Drawing Figure

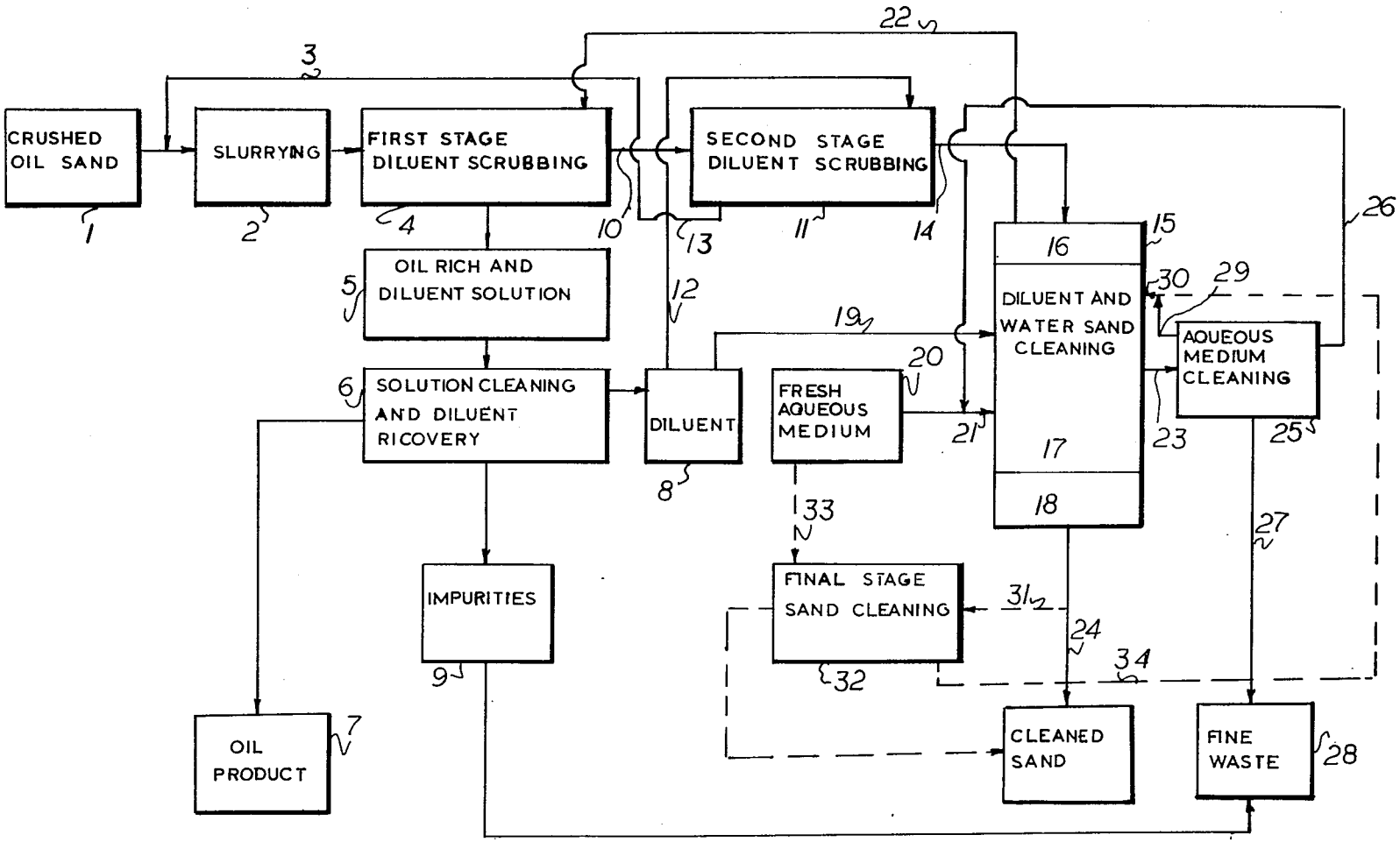
CRUSHED OIL SAND
SLURRYING
FIRST STAGE DILUENT SCRUBBING
OIL RICH AND DILUENT SOLUTION
SOLUTION CLEANING AND DILUENT RICOVERY
IMPURITIES
OIL PRODUCT
DILUENT
SECOND STAGE DILUENT SCRUBBING
FRESH AQUEOUS MEDIUM
DILUENT AND WATER SAND CLEANING
AQUEOUS MEDIUM CLEANING
FINAL STAGE SAND CLEANING
CLEANED SAND
FINE WASTE

PROCESS OF ORGANIC MATERIAL EXTRACTION FROM BITUMINOUS SANDS OR OIL BEARING SANDS

This application is a continuation-in-part of copending application Ser. No. 269,821 filed June 3, 1981, now abandoned.

FIELD OF THE INVENTION

This invention relates to organic material extraction from bituminous sands or oil bearing sands.

More particularly, this invention relates to a method of removing oil from tar, heavy or light oil bearing sands, hereinafter referred to as oil sands, by an improved diluent-cold water process, in a plurality of stages, in counter-current, to yield an oil phase, containing a minor amount of contaminants, without high water and thermal energy requirements or diluent losses in water middlings or sand tailings.

BACKGROUND OF THE INVENTION

The best known methods for bitumen separation from oil sands are the hot water or Clark process and the cold or diluent water processes.

In the hot water process, tar sand, steam and caustic soda are fed into a rotating tumbler or drum to form a slurry at about 80°-85° C., with 20-25% wt. water. In the tumbler the bitumen is released from the sand particles. After screening, to eliminate oversized clay lumps and rock fragments, the slurry is water-flooded and then continuously pumped into a primary separation vessel, where most of the sand particles settle, oil rises to the top and an aqueous middling stream, with fine silt and clay, is withdrawn and secondarily processed to recover entrained oil. Cold water processes include mixing and slurrying oil sands with a hydrocarbon diluent and (or without) process control additives. The slurry, with most of the bitumen from the sand particles, in a diluted form, with low specific gravity, is then mixed with a large amount of water into a separation vessel, where most of the sand particles settle, the bitumen and diluent rise to the top and a middling aqueous stream, with fine silt and clay, is withdrawn.

The hot water process has several disadvantages:

The frothy oil is a hard to break emulsion and needs a relatively expansive cleaning stage, with high energy requirements and bitumen losses.

About 25-30% of bitumen is entrained in the middlings, requiring supplementary costs and energy supply within a secondary process stage.

Important heat losses within the aqueous and sand tailings, practically non settling in the tailing ponds; this means important pond surface, water and energy requirements.

Regarding the cold water processes the main disadvantage is the loss of expensive diluent within the sand tailings.

Another disadvantage is the high water requirement and the fact that waste streams contain pollutants.

To solve the above mentioned disadvantages and to improve the processes several processes have been proposed:

U.S. Pat. No. 4,120,777 claims a process including mildly heating the tar sands mixture with water to about 85°-95° F., in the presence of an alkali metal bicarbonate to warm the mixture to about 100°-130° F. and then recovering bituminous material from the sand, at this temperature, substantially lower than about 180° F. in the hot-water process.

U.S. Pat. No. 3,986,592 claims a cell designed for use in the hot water process comprising a tank with a rotary shaft provided with a sand rake, positioned so as to move settled sand, and two or more deflecting baffles as to provide sufficient residence time in water.

U.S. Pat. No. 4,107,029 claims a process to control the withdrawal rate of the tailings from the hot water primary separation vessel, with a rake torque sensor for the low fines feed and a density gauge for the high fines feed, to better stabilize the separation process and to reach higher yielding of the bitumen in the froth.

U.S. Pat. No. 2,965,557 claims a process for recovering oil and silt from bituminous sand, which comprises: introducing a bituminous sand-diluent mixture into a separation zone to form a lower fluidized bed of sand and an upper liquid layer of oil and silt, injecting large quantities of hydrocarbon diluent into the above mentioned lower bed; pumping the lower product, diluted with water, to a sand washing zone, to form a lower fluidized bed of sand, a water middling and an upper liquid layer of hydrocarbons.

U.S. Pat. No. 4,017,377 claims a process for recovering oil from tar sands, including the steps of: subjecting the sand to a diluent to reduce viscosity of the oil layers surrounding each sand particle; bringing the pre-soaked sand in an aqueous bath having a slightly raised specific gravity and a wetting agent, the released droplets of oil to be rapidly accelerated to the water surface, while the cleaned sand settles to the bottom.

U.S. Pat. No. 4,067,796 claims an improved process for bitumen recovery from tar sand, employing a vessel containing a liquid comprising an organic phase, consisting of a hydrocarbon diluent, and an aqueous phase. This vessel is provided with means of mechanical mixing. Tar sand is introduced into the said vessel, including the mentioned hydrocarbon diluent, at a temperature of 110°-150° F. fresh solvent below the solvent-water interface and fresh water above the bottom of the vessel U.S. Pat. No. 3,941,679 claims an anhydrous process for separating oil from bituminous sand using as diluent trichlorfluormethane (Freon 11), circulating in counter-current with the sand in helical type conveyors.

U.S. Pat. No. 3,875,046 claims a process for extracting oil from tar sand containing fines in a closed-cycle, single stage, using only one extraction vessel in which tar sand is contacted with diluent, steam and hot water containing process control additives, in fluidized bed condition. The cleaned sand is washed in counter-current as to recover heat and additives.

OBJECT OF THE INVENTION

The object of the invention is to provide a cold diluent-water type process, which avoids high heat requirements and heat losses characteristic of the hot water process as well as to avoid the settling and recycling difficulties of water highly contaminated with silt and clay.

SUMMARY OF THE INVENTION

Our invention is a cold diluent-water type process, used to avoid the high heat requirement, heat losses of the hot water process and the major settling and recycling difficulties of highly contaminated water with disperse silt and clay. Preferably the process is carried out to room temperature, in continuous flow.

We found that with the prior art methods of fluid extraction it is not possible to obtain high oil yields from oil sands containing the same, in a diluent-oil product easy to be refined, with the highest oil to diluent ratio, using little circulating and fresh diluent, with low contaminants content in the aqueous medium, and low requirements of circulating and fresh water.

Our invention is able to be carried out, to process raw materials as bituminous sands or oil bearing sands, hereinafter referred to as oil sands, having physico-chemical characteristics which vary in a wide range.

Our process consists of: slurrying the crushed (if necessary) oil sand with diluent, within a conditioning drum, provided at the discharge end with a screen to remove the oversize rocks, lumps,; driving the screened slurry into one or two helical, classifier type, separators to move it in counter-current with diluent, to obtain, through several minutes contact time, the largest quantity of oil, withdrawing in the lower part of the helical separator(s), as overflow with high oil content in diluent solution, carrying the finest clay minerals, in a low viscosity, nonemulsified, product, easy to be refined, to obtain: an oil product free of contaminants; a product containing impurities; and a diluent product for recycling. The sand saturated with diluent and relatively little oil from this stage, withdrawn in the upper part of the separator(s), is fed into a separation column, to settle by gravity first through a diluent upper layer and then through an aqueous medium, under and in direct contact with the diluent medium, to the bottom of the vessel, as sand layer, substantially free of oil. In order to provide a sufficient residence time for the sand falling through the separation media, to gently agitate the settled sand and consequently to improve the washing efficiency in this stage, the column is provided with a shaft, not shown in the drawing, with several deflecting baffles and a rake in the lower part of the shaft, at the bottom of the column.

Diluent is added, below the diluent-water interface, as well as water, with process control additives, into the lower part of the aqueous medium zone. Consequently, constant characteristics of the separation media and a slight upwardly moving of them are maintained, in a continuous flow.

To obtain the best separation effect in this stage, a process control medium made of soda ash, 1 to 5 kg/m$^3$, sodium silicate, 1 to 5 kg/m$^3$, and a demulsifier, such as a block-polymer type of propylene and ethylene oxides, 0.2–3 kg/m$^3$, is added in the aqueous medium, the aqueous medium becomes slightly alkaline, does not disperse clays, has a density slightly over 1 and the sand particles become well water-wet and no emulsifying, at the diluent-water interface, neither in the oil-diluent layer, nor in the aqueous layer is present; for large varieties of oil sands characteristics such an additive combination is very efficient, the process being not so sensitive, as the hot water process. The additives are added only in the fresh water, the treated, recycled water already containing them.

From the column there are withdrawn the following: a diluent stream with little oil, in the upper part; an aqueous middling, impurified with silt and clay, but essentially free of oil and diluent, in the middle, in the opposite part of diluent and water inlets, and between them; the sand, settled in the bottom.

The oil-diluent product is recycled in the process; the middling is treated to obtain remanent oil and diluent (if any), clarified water, for recycling, and a fine waste; the sand is either withdrawn to disposal or, if necessary, may be finally cleaned by scrubbing in a helical, classifier type, separator, in counter-current by water, with process control additives.

BRIEF DESCRIPTION OF THE DRAWING

The drawing is a schematic representation of the process flow arrangement to carry out the preferred embodiment of our invention. The figure represents process phases as presented in the summary, realizable by process equipment, known in the art such as the hot water process, ore dressing. Details such as pumps, valves, belt conveyors, system for process control and monitoring, are not shown, but it is understood that those skilled in the art will be able to make and use it.

DETAILED DESCRIPTION OF THE DRAWING

The process of our invention will be better understood by reference to the drawing.

Crushed (if necessary) oil sand, shown at 1, is fed into the rotating conditioning drum 2, where it is slurried by a recirculated low-grade oil and diluent solution 13, from a process stage described below, via line 3.

The slurry is fed into the lower part of a helical separator 4, in counter-current, with a very diluted oil-diluent solution from the vertical separation vessel 15, sprayed into the upper part of the helical separator, via line 22, by a suitable set of nozzles.

By intimate, long time, contact of the sand and diluent, circulated in counter-current, most of the oil is obtained in the lower part of the helical separator as overflow of an oil-rich and diluent solution 5. This low viscosity solution, with relative little impurities content, such as fine silt, clay and water, is refined in 6 by a conventional method, not described here, to obtain the oil product 7, the diluent 8 for recycling, and a slime 9, consisting of mineral impurities, water, oil and diluent The slime 9 is directed to the fine waste disposal 28, together with the slime from the aqueous medium cleaning 25.

The sand saturated with diluent and relatively little oil from this stage is withdrawn, via line 10, in the upper part of the separator and is fed into the helical separator 11 as to be scrubbed, in a similar way, in counter-current with recycled diluent from 8, via line 12, as to obtain in the overflow a low-grade oil-diluent solution 13, for recycling to the conditioning stage.

In another preferred embodiment, for the low-grade or for the easy to process oil sands, the second diluent scrubbing stage may be by-passed and the sand 10 is directed to the diluent and water sand cleaning 15, as shown below. In these cases, the diluent for the first stage flushing, will be the recycled diluent from 8.

The sand from this second stage, saturated with diluent, and little oil, via line 14 is withdrawn, in the upper part of the separator and fed into the column 15, to settle by gravity, first through the diluent medium 16 and then through the aqueous medium 17, to the bottom of the column, as sand layer 18, essentially free of oil.

A rotating shaft with deflecting baffles and a rake, not shown in the drawing, contribute for a better sand cleaning, by longer residence time in the media and for a light mixing of the settled sand to allow oil droplets to escape and rise to the diluent layer.

A stream of recovered diluent from 8, via line 19, below the diluent-water interface, and, via line 21, a mixture of fresh water with process control additives from 20 and recycled water from the aqueous medium cleaning 25, via line 26, are added into the lower part of the aqueous medium zone.

A stream of diluent with little oil is withdrawn in the upper part of the column, via line 22, as diluent phase for the first scrubbing stage 4, an aqueous impurified medium in the middle part of the vessel in the water phse, via line 23, below the line 19 and above line 21, in diametral opposite position with these lines, and a sand settled flow at the bottom of the vessel, via line 24.

The aqueous medium from 23 is treated in 25, by methods which are not claimed in the invention, to recover oil (if any), clarified water for recycling, via line 26, and mineral impurities as a slime of the same with water and traces of oil, via line 27, for disposal as fine waste 28 together with the slime impurities 9 from the oil product cleaning 6.

The oil-diluent product (if any) 29 is recycled to the separation vessel, via line 30.

If necessary, the sand, withdrawn via line 24, may be finally cleaned by introducing it, via line 31, in the helical separator 32 as to be scrubbed in counter-current in a similar way as in the separators 4 and 11, by water with process control additives from 20, via line 33. The recovered here oil-diluent product is recycled, via line 34, in the column 15.

The efficiency of our application may be more readily understood by reference to the examples shown in the following table:

| Parameters | Example 1 | 2 | 3 | 4 |
|---|---|---|---|---|
| Oil content of the oil sand, % wt | 8.7 | 11.4 | 14.4 | 17.1 |
| Silt and clay content in the mineral matter, % wt | 20.0 | 24.8 | 9.8 | 5.5 |
| Fluid phase in the conditioning step, % wt | 40 | 36 | 40 | 42 |
| Diluent/oil ratio in the conditioning step | 3.4 | 2.3 | 2.0 | 1.4 |
| Diluent/oil ratio in the first classifier overflow (oil rich-diluent solution) | 4.0 | 3.8 | 3.8 | 2.8 |
| Diluent/oil ratio in the second classifier overflow | 25.3 | 12.0 | 14.3 | 6.7 |
| Diluent/oil ratio in the oil-diluent product from the column | 54.6 | 40.6 | 33.2 | 14.7 |
| Total diluent/oil sand ratio in the process | 1.02 | 1.12 | 1.31 | 1.20 |
| out of which: | | | | |
| recovered and recycled diluent | 0.42 | 0.45 | 0.36 | 0.48 |
| recycled in the process oil-diluent solutions | 0.60 | 0.68 | 0.95 | 0.72 |
| Total water requirement in the process cu m/t oil sand | 1.75 | 1.12 | 0.97 | 1.26 |
| out of which: | | | | |
| fresh water, cu m/t oil sand | 0.31 | 0.22 | 0.30 | 0.41 |
| treated and recycled water, cu m/t oil sand | 1.44 | 0.90 | 0.67 | 0.85 |
| Oil recovery in the oil rich and diluent solution, % wt | 99.2 | 98.2 | 99.9 | 98.1 |
| Diluent recovery in the oil rich and diluent solution, % wt | 98.2 | 97.2 | 99.1 | 98.2 |
| Net oil recovery in the oil product % wt | 90.4 | 94.6 | 98.0 | 97.6 |
| Oil and diluent content in the cleaned sand, % wt | 0.8 | 0.8 | 0.3 | 0.3 |
| Oil and diluent content in the fine waste, % wt | below 0.1 | below 0.1 | 0.4 | 0.1 |

While particular embodiments of the present invention have been shown and described, it will be obvious to those skilled in the art that changes and modifications may be made without departing from the spirit and scope of the invention.

We claim:

1. A cold water diluent process for recovering oil from bituminous or conventional oil sands thereafter referred to as oil sands, including the steps of:

(a) conditioning the optionally crushed oil sand, by diluent slurrying in a rotating drum, provided on its outlet end with a screen to reject oversized rocks, lumps, so that the diluent/oil ratio is between 1.4 and 3.4;

(b) introducing the slurry into the lower part of one or successively two helical, classifier type, separators, to be scrubbed in counter-current with diluent, fed into the upper part of the separator(s) by spraying;

(c) withdrawing from the lower part of the first helical separator a rich oil-diluent product having a diluent/oil ratio between 2.8 and 4.0, with some fine silt and clay, and recovering most of the oil contained in the sand;

(d) refining by a conventional method, this low viscosity oil-diluent product as to obtain:
an oil product, free of contaminants;
a product containing the impurities, with some oil and diluent;
a diluent product to be recycled in the process;

(e) feeding the sand, saturated with diluent and relatively little oil, withdrawn in the upper part of the second helical separator, into a separation column to settle, first through a diluent upper layer and then through an aqueous medium, under and in direct contact with the diluent layer, to the bottom of the column, essentially free of oil;

(f) introducing, into the said column, diluent, under the diluent-water media interface and a mixture of slightly alkaline, not dispersing clay, recycle and fresh water, and process control additives, into the lower part of the aqueous medium, as to maintain constant characteristics and a slightly upwardly moving of the media;

(g) withdrawing from the said column:
a diluent stream with little oil in the upper part;
an aqueous impurified middling, in the opposite part of diluent and water inlets and between them;
a sand settled in the bottom;

(h) recycling the diluent with little oil to the first scrubbing stage;

(i) treating the aqueous medium by conventional method to obtain:
remanent oil and diluent, if any;
clarified water to recycling;
a fine waste;

(j) disposing, or, if necessary, finally cleaning the sand by scrubbing in a helical, classifier type, separator, in counter-current with water and with process control additives.

2. The cold water diluent process as defined in claim 1, carried out at room temperature, in continuous flow.

3. The cold water diluent process as defined in claim 1, reaching an oil product with a high oil yielding, free of contaminants and a cleaned sand with low oil-diluent content.

4. The cold water diluent process as defined in claim 1, with a closed cycle diluent use.

5. The cold water diluent process as defined in claim 1, in which diluent losses are replaced by appropriate conducting of the distillation stage in the refining process of the oil rich-diluent solution.

6. The cold water diluent process as defined in claim 1, in which an aqueous medium is provided with a combination of process control additives made of soda ash, sodium silicate and a demulsifier.

7. The cold water diluent process as defined in claim 6, the demulsifier being a blocking-polymer type of propylene and ethylene oxides.

8. The cold water diluent process as defined in claim 6, where the soda ash will be added in an amount the 1–5 kg of sodium silicate in an amount of 1–5 kg and a demulsifier in an amount of 0.2–3 kg to 1 cu. m. water, the resulting aqueous medium being slightly alkaline and having a density slightly over 1 .

9. The cold water diluent process as defined in claim 1, where better than 97.2 of the diluent and better than 90% of the oil are recovered obtained by:

conditioning the oil sand by diluent slurrying before the first oil separation stage, in a conditioning rotating drum, wih recycled low grade oil-diluent solution from the first diluent scrubbing stage;

scrubbing the conditioned sand with diluent and separating the most part of the oil contained in the oil sand, in 1–2 helical, classifier type, separators, sand and diluent circulating in counter-current; and slightly agitating the settled sand in the column.

10. The cold water diluent process defined in claim 1 wherein part of the aqueous medium impurified with silt, clay and water-soluble oil compounds is withdrawn and replaced by a mixture of fresh water with additives and treated recycle water, in order to maintain constant characteristics of the aqueous separation medium and to replace the water lost along with the said tailings.

* * * * *